US007314293B2

(12) United States Patent
Steier et al.

(10) Patent No.: US 7,314,293 B2
(45) Date of Patent: Jan. 1, 2008

(54) LAMP HAVING INTERCHANGEABLE DECORATIVE PANELS

(76) Inventors: Frederick Steier, 5266 Venalden Ave., Tarzana, CA (US) 91356; David Stein, 18716 Prairie St., Northridge, CA (US) 91324

( * ) Notice: Subject to any disclaimer, the term of this patent is extended or adjusted under 35 U.S.C. 154(b) by 0 days.

(21) Appl. No.: 11/193,101

(22) Filed: Jul. 29, 2005

(65) Prior Publication Data

US 2006/0023460 A1 Feb. 2, 2006

Related U.S. Application Data

(60) Provisional application No. 60/592,955, filed on Jul. 30, 2004.

(51) Int. Cl.
*F21V 11/00* (2006.01)

(52) U.S. Cl. ..... 362/351; 40/554

(58) Field of Classification Search ..... 362/351, 362/353, 358; 40/554
See application file for complete search history.

(56) References Cited

U.S. PATENT DOCUMENTS

| | | | | |
|---|---|---|---|---|
| 1,463,722 | A * | 7/1923 | O'Boyle | 428/14 |
| 2,177,204 | A * | 10/1939 | Buzick et al. | 40/554 |
| 2,714,153 | A * | 7/1955 | Talbot | 362/353 |
| 4,163,998 | A * | 8/1979 | Anderson et al. | 362/358 |
| 6,736,530 | B2 * | 5/2004 | Thevenot | 362/362 |
| 2004/0130899 | A1 * | 7/2004 | Skouras et al. | 362/351 |

* cited by examiner

*Primary Examiner*—Sandra O'Shea
*Assistant Examiner*—James W Cranson, Jr.
(74) *Attorney, Agent, or Firm*—Kelly Lowry & Kelley, LLP

(57) ABSTRACT

A lamp including a holder having a base with a plurality of vertical walls extending upwardly therefrom. A window is formed in at least one of the walls. A panel, including an image, is removably disposed adjacent to the window. The panel is illuminated to highlight the image and create a desired effect.

20 Claims, 3 Drawing Sheets

LAMP HAVING INTERCHANGEABLE DECORATIVE PANELS

RELATED APPLICATION

This application claims priority to U.S. Provisional Application Ser. No. 60/592,955, filed Jul. 30, 2004.

BACKGROUND OF THE INVENTION

The present invention generally relates to candle holders and lamps. More particularly, the present invention relates to a candle holder/lamp which has interchangeable decorative panels to meet the desires of the user.

Incandescent lamps are well-known. Typically, a lamp will have a semi-transparent shade placed thereover such that light can pass therethrough in a muted manner. Lamp shades come in a variety of sizes and colors and decorative designs to meet the needs and desires of the owner of the lamp. However, in order to change the aesthetic appearance of the lamp, an entire lamp shade must be replaced. Moreover, such lamp shades typically do not have cut-outs or other such decorative designs therein which are illuminated by the lamp, or which cast illuminated designs on objects, such as walls, surrounding the lamp.

Candle holders are also well-known. There do exist some candle holders which have housings with cut-out designs formed therein. While these cut-out designs serve to please the user by having such illuminated designs surrounding the candle resulting in illuminated designs cast onto walls and other objects surrounding the candle holder, such candle holders are very limited in their use. This is due to the fact that the images are not capable of being altered to meet the whims of the owner of the candle holder.

Accordingly, there is a continuing need for a candle holder or lamp shade which has removable and interchangeable decorative panels. The present invention fulfills these needs and provides other related advantages.

SUMMARY OF THE INVENTION

The present invention resides in a lamp having removable and interchangeable decorative panels. The lamp generally comprises a multi-facetted holder including a plurality of vertical walls. In a particularly preferred embodiment, the holder includes a base, with the vertical walls extending upwardly therefrom. In a particularly preferred embodiment, the holder has a generally triangular cross-sectional configuration.

A window is formed in at least one of the walls. A panel, including an image, is removably disposed adjacent to the window so as to substantially occupy the window.

The holder may include tracks for removably receiving edges of the panel therein. Means are provided for illuminating the panel, at least a portion of which permits light to pass therethrough to form a desired image and effect.

In one embodiment, the illuminating means comprises an electrical lamp disposed within the holder. In another embodiment, the illuminating means comprises a candle disposed within the holder. In one embodiment, the panel comprises a photograph. A transparent or translucent sheet may be disposed over the photograph.

The panel may be cut, etched or printed to form the desired image. In one embodiment, the panel comprises a transparent or translucent material, and wherein the panel, with the exception of the image, is opaque. In this manner, the image is illuminated by the candle or electric lamp. A colored translucent sheet may be disposed adjacent to the panel for coloring the image, or creating other desired effects.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
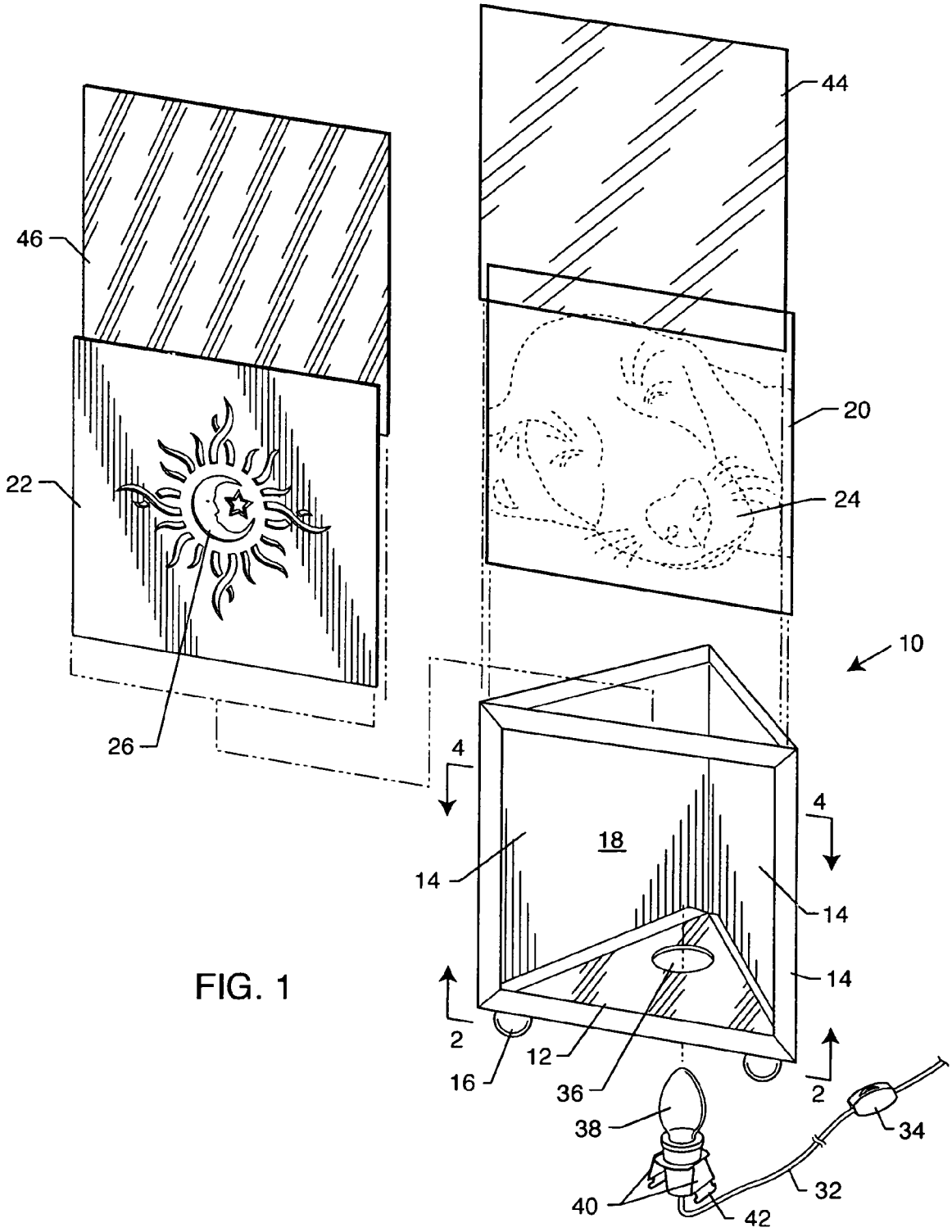
FIG. 1 is an exploded perspective view of a lamp embodying the present invention, with component parts thereof.

As shown in the drawings, for purpose of illustration, the present invention resides in a lamp, generally referred to by the reference number 10. The term lamp, as used herein, refers to a device which generates light and includes electric lamps and candle-lit lamps. More particularly, the present invention is directed to such a device having interchangeable decorative panels to create a desired effect, as disclosed more fully herein.

Figure 2:
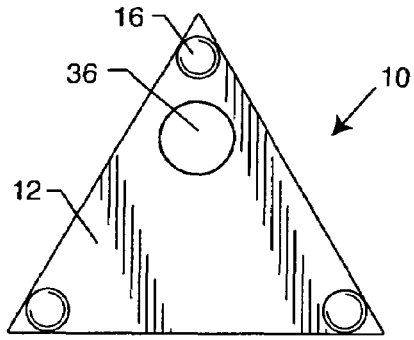
FIG. 2 is a bottom plan view taken generally along line 2-2 of FIG. 1.

With reference now to FIGS. 1 and 2, the lamp 10 is comprised of a holder having a base 12 and a plurality of walls 14 extending vertically therefrom. The base 12 and walls 14 serve to hold a light source, as will be more fully discussed herein. It will be appreciated that the invention may not need a base 12 at all, but rather vertical walls 14 defining an enclosure for the light source. However, in the preferred illustrated embodiment, such vertical walls 14 extend upwardly from the base 12 so as to define an enclosure for the light source. Typically, the base and walls 12 and 14 defining the holder are comprised of a sufficiently rigid and durable material, such as metal.

The lamp 10 is multi-facetted in the sense that it includes a plurality of vertical walls 14. In a particularly preferred embodiment, as illustrated, the lamp 10 has a generally triangular cross-sectional configuration. However, other configurations are contemplated by the present invention. The lamp 10 is intended to be aesthetically pleasing and decorative in nature so as to be placed within one's home or office. As such, the base 12 may include decorative feet 16, platforms or other risers.

With reference now to FIGS. 1-5, at least one window 18 is formed in at least one of the vertical walls 14. As illustrated, a single window 18 is formed in substantially an entire front wall 14. The window 18 is typically square so as to occupy the majority of the facet of the vertical wall 14, although the invention is not limited to such.

With reference to FIG. 1, panels 20 and 22, which include an image 24 and 26, respectively, are configured and sized so as to be disposed adjacent to the window 18. In certain configurations, such as the illustrated triangular configuration of lamp 10, a square panel 20 or 22 which is approximately the size of the vertical wall 14 can simply be inserted within the lamp holder 10 immediately behind the window 18, and be sufficiently retained in place by the other two converging vertical walls 14. However, in a particularly preferred embodiment, tracks 28 are formed in the lamp holder 10 adjacent to the window 18 for receiving opposite edges of the panel 20 or 22 so as to retain the panel 20 or 22 in place within the window 18. Such tracks 28 may be necessary in other configurations in order to retain the panel 20 or 22 within the window 18 so as to substantially occupy the window 18 with the panel 20 or 22 and image 24 or 26. Such tracks 28 can comprise the same material as the vertical walls 14, and are preferably elongated and disposed on opposite vertical sides of the window 18, as illustrated. Preferably, the tracks 28 permit the removable insertion of not only a panel 20 or 22, but other sheets, as will be more fully described herein.

Figure 3:
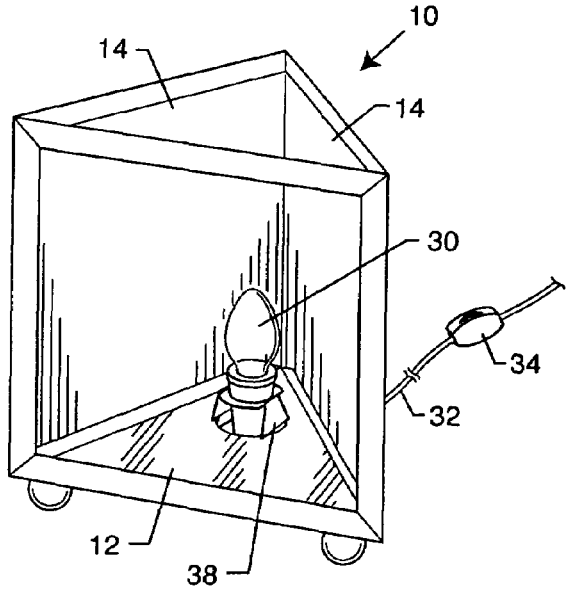
FIG. 3 is a front perspective view of an incandescent lamp positioned within a holder of the lamp, in accordance with the present invention.
Figure 4:
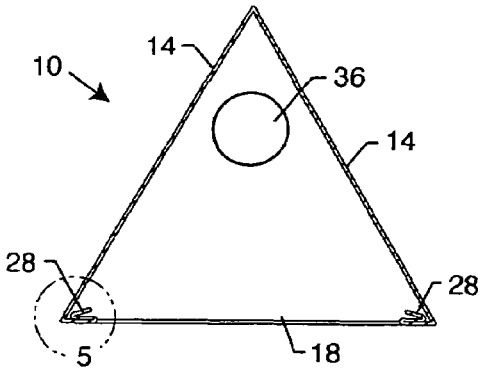
FIG. 4 is a cross-sectional view taken generally along line 4-4 of FIG. 1, illustrating tracks for holding a panel, in accordance with the present invention.
Figure 5:
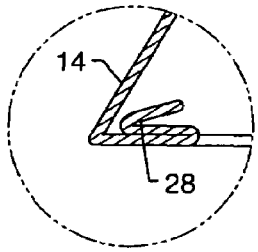
FIG. 5 is an enlarged view of area "5" of FIG. 4, illustrating a track used in accordance with the present invention.

With reference now to FIGS. 1 and 3, in one embodiment, the light source is an electric incandescent bulb 30. The bulb 30 is connected to a power cord 32 having an on/off switch 34 for selectively powering the incandescent bulb 30. Of course, the light switch 34 could be omitted and the incandescent lamp 30 plugged in or out of a wall socket to selectively power it.

In a particularly preferred embodiment, the base 12 includes an aperture 36 sized and configured so as to receive the incandescent lamp 30 therethrough. The incandescent bulb 30 preferably includes means for retaining it within the lamp holder 10. As illustrated, a spring clip 38 is used to removably secure the incandescent bulb 30 within the lamp holder 10. The clip 38 is comprised of opposed resiliently flexible wings 40 having an indentation or groove 42 which engages the peripheral edge of aperture 36, as illustrated in FIG. 3. In this manner, the incandescent lamp 30 can be easily removed from the lamp holder 10, such as when replacing the light bulb 30, or using other lighting sources, as will be more fully described herein. Of course, it will be understood that the light bulb 30 may not be removably attached to the lamp holder 10, but be a permanent fixture thereof as dictated by the needs of the end user.

Figure 6:
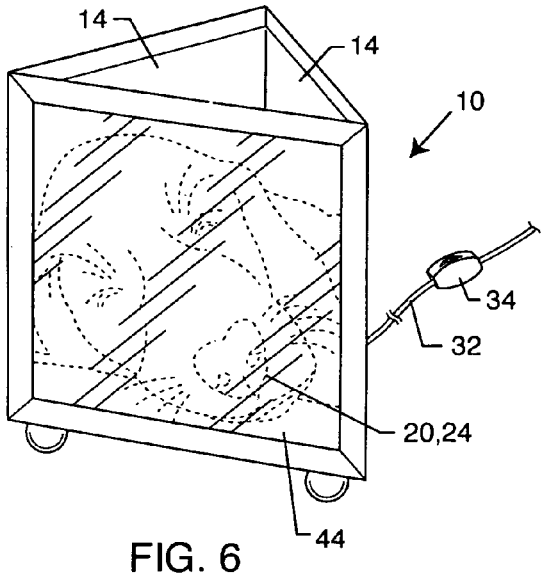
FIG. 6 is a front perspective view of the lamp of the present invention, with a photograph panel placed in a window of the lamp, in accordance with the present invention.

With reference now to FIGS. 1 and 6, in one embodiment, the decorative panel 20 comprises a photograph, such as the illustrated photograph depicting an image of a dog 24. The photograph 20 can be cut to be sized to fit the window 18. When the electric bulb 30 is powered on and illuminated, a back lighting effect is created to illuminate the photograph and create a very aesthetically pleasing look, especially when in darkened rooms. To enhance this effect, plastic sheets 44 may be placed in front of the photograph 20 to alter its appearance. For example, a clear plastic sheet 44 may be placed in front of the photograph 20 to give it a more shiny appearance. It will be appreciated that the incandescent lamp 30 is preferably of a low wattage so as to produce very little heat within the holder 10. This enables photographs 20 and relatively thin plastic sheets 44 having a low melting point to be utilized.

Figure 7:
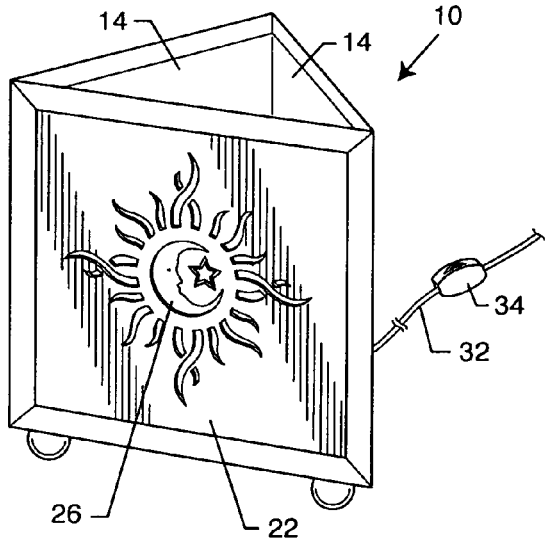
FIG. 7 is a front perspective view similar to FIG. 6, but having a panel with an image therein, in accordance with the present invention.

With reference now to FIGS. 1 and 7, instead of a photograph 20, the end user may purchase decorative panels 22 having an image 26 formed thereon or therein. Such decorative panels 22 can be comprised of a variety of materials. For example, the decorative panels 22 can be comprised of a thin sheet of metal, with the image 26 cut out or etched therein. Thus, when placed in front of the window, as shown in FIG. 7, and illuminated from behind by the incandescent bulb 30, the cut-out image 26 is illuminated to create the desired effect in a darkened room. It has been found that a chemical etching process can provide such designs 26 with a great amount of detail. The lamp holder 10 can be positioned such that the image 26 is projected into the room, or against a wall or other backdrop surface to create additional desired effects.

Instead of an etched metal decorative panel 22, other decorative panels can be used. For example, the panel 22 may comprise a plastic sheet. The decorative image 26 can be etched or cut out from this plastic sheet. Alternatively, the plastic sheet may be generally translucent or transparent in nature. A reverse silk-screen image is formed in black or other opaque color onto the panel 22 to block out the light and form the desired image 26. Preferably, the image 26 allows the light to pass therethrough, although the opposite effect may also be created. In a particularly preferred embodiment, the panel 22 comprises a plastic PVC plate approximately four to five inches square and approximately ten millimeters thick. The sheet may be clear, or frosted to diffuse light. An opaque color is then formed on the panel 22 to create the desired image 26.

With reference again to FIG. 1, a colored translucent sheet 46 may be disposed adjacent to the panel 22, either immediately in front of or behind the panel 22 so as to create a colored image 26. Such sheet 46 may be comprised of a colored gel material, which may be adhered to the panel 22 or slid in front of or behind the panel 22, such as in the previously described tracks 28. Such diffusers 46 may be of any color, such as red, blue, etc. This imparts different colors to the image 26 and different effects. Colored diffuser sheets 46 may be selectively removed and added to change the color of the image 26.

The decorative panel 22 can have any number of cut-out, etched or printed images 26. For example, company logos, abstract images, themed images, etc., can all be formed on respective decorative panels 22. The light from within the lamp holder 10 illuminates these images much the same way as Jack-O-Lantern cut-out portions are emphasized when lit. In fact, the decorative panels 22 of the present invention could include Halloween-themed images 26, within an orange diffuser 46 positioned behind the panels 22. These panels 22 could be removed and replaced with Thanksgiving, Christmas, Independence Day, etc., themed images 26. Also, the panel 22 can be removed and reinserted into the tracks 28 after having been turned around such that any text formed in the panel 22 can be projected onto a wall or other surface near the lamp holder 10 and the protected text will not appear backwards.

It is also contemplated that dimension could be given to the image 26. This would be performed by the printing or etching process. Alternatively, two panels 22 would be placed within the track 28 back-to-back such that dimension is given to the overall image 26. For example, a tiger can be formed in a front panel 22, while a jungle scene is formed from the back panel 22, such that the images overlap and have dimension either when viewed directly, or on a wall, or other backdrop.

Figure 8:
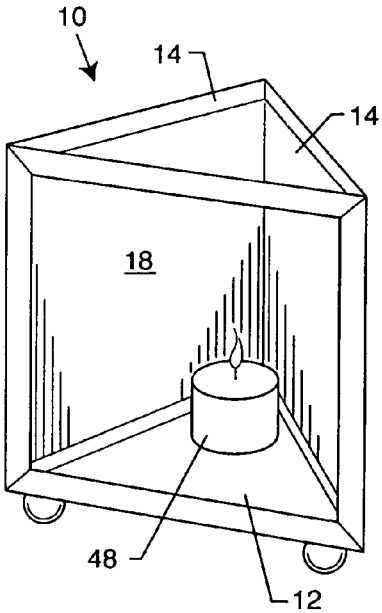
FIG. 8 is a front perspective view similar to FIG. 3, but illustrating use of a candle, in accordance with the present invention.

With reference now to FIG. 8, instead of utilizing an electric incandescent light bulb 30, a candle, such as a tealite or votive candle can be placed within the lamp holder 10 to serve as the source of illumination. In the preferred embodiment, the electric incandescent lamp 30 and cord 32 would be removed from the lamp holder 10. This would enable the placement of one or more candles 48 therein. Access to the candle 48 could be accomplished through the upper opening of the holder 10, or through an open window 18. This could be done by raising the front decorative panel 22 in order to light the candle. Similar effects could be created, as described above, but with flickering candlelight. This could be particularly desirable for Halloween-themed candles 22 or a more romantic or intimate projection of an image of a photograph 24 or the like.

Figure 9:
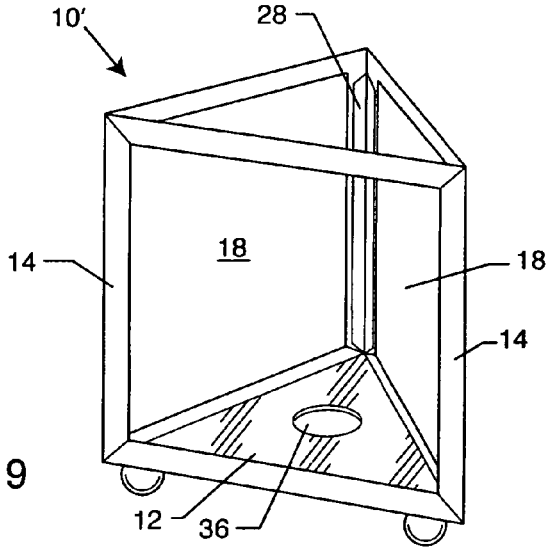
FIG. 9 is a front perspective view of another holder, having a plurality of windows in accordance with the present invention.

With reference to FIG. 9, the holder 10' can include multiple windows 18 formed the multiple vertical walls 14. In fact, every vertical wall 14 can have a window 18 formed therein such that many decorative panels 20 or 22 can be used simultaneously. All the decorative panels 22 can have the same image or design 26, or different images such that a different angle of viewing of the lamp 10' can produce a different image when either viewed directly or on a reflective surface nearby. Tracks 28 can be formed in the corners between the walls 14 to retain the panels 20 or 22 therein. As previously discussed, the tracks 28 are preferably elongated and run substantially from the top to the bottom of the holder 10 adjacent to the window 18.

The lamp 10 of the present invention provides many advantages over existing lamps, shades and candle holders. The photographs 20 or panels 22 can be easily and quickly inserted or removed to create a different desired effect. Thus, the end user need only purchase the lamp holder 10, and insert his or her own photographs 20, or purchase one or more decorative panels 22 for use in the holder 10, instead of replacing the entire lamp 10 itself in order to alter the overall appearance of the lamp 10.

Although several embodiments have been described in detail for purposes of illustration, various modifications may be made to each without departing from the scope and spirit of the invention. Accordingly, the invention is not to be limited, except as by the appended claims.

What is claimed:

1. A lamp, comprising:

a multi-faceted holder including a generally planar and multi-faceted base plate having a plurality of vertical walls extending upwardly therefrom;

a window formed in at least one of the walls;

a panel, including an image, removably disposed adjacent to the window, wherein at least a portion of the panel permits light to pass therethrough; and means for illuminating the panel supported within the holder by the base plate.

2. The lamp of claim 1, wherein a window is formed in at least two of the vertical walls.

3. The lamp of claim 1, wherein the panel comprises a photograph.

4. The lamp of claim 3, including a transparent or translucent sheet disposed over the photograph.

5. The lamp of claim 1, wherein the panel is cut, etched or printed to form the image.

6. The lamp of claim 5, wherein the panel comprises a transparent or translucent material, and wherein the panel, with the exception of the image, is opaque.

7. The lamp of claim 6, including a colored translucent sheet disposed adjacent to the panel.

8. The lamp of claim 1, wherein the illuminating means comprises an electric lamp extending upwardly through an aperture in the base plate so as to be disposed within the holder.

9. The lamp of claim 1, wherein the illuminating means comprises a candle disposed on the base plate within the holder.

10. The lamp of claim 1, including open-ended first and second tracks formed in the holder adjacent to opposite sides of the window for removably receiving edges of the panel therein.

11. The lamp of claim 1, wherein the holder has a generally triangular cross-sectional configuration.

12. The lamp of claim 11, wherein the base plate is of a generally triangular configuration.

13. The lamp of claim 8, including a spring clip for securing the electric lamp to the base plate.

14. The lamp of claim 13, wherein the spring clip comprises opposed resiliently flexible wings biased outwardly to engage a peripheral edge of the base plate aperture.

15. A lamp, comprising:

a holder having a generally triangular cross-sectional configuration, the holder including a generally triangular base plate having three vertical walls extending upwardly therefrom;

a window formed in at least one of the walls;

open-ended first and second tracks formed in the holder adjacent to opposite sides of the at least one window;

a panel, including an image, removably inserted into the first and second tracks so as to be disposed adjacent to the window, wherein at least a portion of the panel permits light to pass therethrough; and an electric lamp extending upwardly through an aperture in the base plate so as to be disposed within the holder.

16. The lamp of claim 15, wherein the panel comprises a photograph.

17. The lamp of claim 15, wherein the panel is cut, etched or printed to form the image.

18. The lamp of claim 15, wherein the panel comprises a transparent or translucent material, and wherein the panel, with the exception of the image, is opaque.

19. The lamp of claim 15, including a spring clip for securing the electric lamp to the base plate.

20. The lamp of claim 19, wherein the spring clip comprises opposed resiliently flexible wings biased outwardly to engage a peripheral edge of the base plate aperture.

* * * * *